United States Patent [19]

Uranishi et al.

[11] Patent Number: 4,700,683

[45] Date of Patent: Oct. 20, 1987

[54] DEVICE FOR PURGING EVAPORATED FUEL CAPTURED BY A CHARCOAL CANISTER

[75] Inventors: Kouji Uranishi, Susono; Takaaki Itou, Mishima, both of Japan

[73] Assignee: Toyota Jidosha Kabushiki Kaisha, Aichi, Japan

[21] Appl. No.: 838,266

[22] Filed: Mar. 10, 1986

[30] Foreign Application Priority Data

Mar. 12, 1985 [JP] Japan ..... 60-34200[U]

[51] Int. Cl.[4] ..... F02M 33/02

[52] U.S. Cl. ..... 123/519; 123/520

[58] Field of Search ..... 123/519, 520

[56] References Cited

U.S. PATENT DOCUMENTS

| | | | |
|---|---|---|---|
| 4,308,842 | 1/1982 | Watanabe | 123/519 |
| 4,377,142 | 3/1983 | Otsuka | 123/520 |
| 4,475,522 | 10/1984 | Oonaka | 123/520 |
| 4,495,904 | 1/1985 | Sakaino | 123/520 |
| 4,527,532 | 7/1985 | Kasai | 123/520 |

FOREIGN PATENT DOCUMENTS

| | | | |
|---|---|---|---|
| 58-133466 | 9/1983 | Japan | 123/519 |
| 59-176456 | 5/1984 | Japan | 123/520 |

*Primary Examiner*—Ronald B. Cox

*Attorney, Agent, or Firm*—Kenyon & Kenyon

[57] ABSTRACT

Device for purging evaporated fuel captured by a charcoal canister from a fuel supply system of an engine. A purge path connects the charcoal canister to an engine intake path, an ON-OFF valve and a fixed throttle are arranged in parallel in the purge path, and a solenoid valve is provided in the purge path between the engine intake path and the parallel ON-OFF valve and fixed throttle. The solenoid valve is opened only at low engine speeds and low engine temperatures. The ON-OFF valve is opened at engine loads higher than a predetermined engine load and is closed at engine loads lower than the predetermined engine load. In this way, purging of the evaporated fuel is cut off at low engine speeds and low engine temperatures, purging is occurs small quantity at low engine loads, and purging is increased at high engine loads, providing increased capturing ability of the charcoal canister without impairing drivability.

7 Claims, 2 Drawing Figures

DEVICE FOR PURGING EVAPORATED FUEL CAPTURED BY A CHARCOAL CANISTER

BACKGROUND OF THE INVENTION

1. Field of the Invention

The present invention relates to a device for purging evaporated fuel captured by a charcoal canister for an internal combustion engine:

2. Description of the Prior Art

Fuel evaporated from a fuel tank or a float chamber of a carburetor of an internal combustion engine is usually captured by charcoal in a charcoal canister and is purged into an intake path of the internal combustion engine. To improve the fuel capturing ability of the charcoal canister, a large flow volume of purging air is required. However, when the flow volume of the purging air is increased, the air/fuel ratio of the intake gas taken into the engine becomes lean, because the purging gas is introduced into an intake path of the engine downstream of the carburetor. Especially when the flow volume of the engine intake gas is small, such as at low engine loads, the lean air/fuel mixture intake gas impairs the drivability of the engine.

To remedy the above problem, Japanese Utility Model Publication SHO No. 55-170463 discloses improved evaporated fuel purging device. The device is provided with a fixed area throttle which, in one embodiment, always allows a small volume flow of a purge gas including evaporated fuel and two vacuum-actuated flow control valves which are arranged one in series and one in parallel with the fixed throttle. The series flow control valve opens when engine loads reach a predetermined value which is set at a comparatively low engine load. The opening degree of the valve in parallel with the fixed throttle gradually increases in proportion to the increase in the engine load, thereby increasing the purging of the evaporated fuel in proportion to the increase in the intake gas taken into the engine. The flow control valve in parallel with the fixed throttle in one embodiment is controlled by utilizing the vacuum in an intake manifold provided downstream of a throttle valve.

However, the above-mentioned conventional purging device has a very complicated structure and in one embodiment requires two vacuum-actuated flow control valves, resulting in an inevitable increase in cost. In addition, since the device utilizes vacuum in the intake manifold, which usually varies according to engine loads, at engine start when not enough evaporated fuel has yet been captured by a charcoal canister, and when the throttle valve is opened, which usually results in a sudden decrease of vacuum in the engine intake path and a sudden increase in volume flow of the purging gas, the engine is liable to stall, and also control of the air/fuel ratio of the gas mixture is liable to deteriorate. Further, since such a sudden change of the air/fuel ratio can not be fed-back, NOx in the engine exhaust gas is liable to increase and the catalytic convertor can not operate normally

SUMMARY OF THE INVENTION

An object of the present invention is to provide an evaporated fuel purging device which has a simple structure and includes only a single vacuum-actuated ON-OFF valve in a purge path, thereby decreasing the cost, and which allows a large volume of purging gas to flow into the engine intake path without impairing the drivability of an automobile, while increasing the capturing ability of a charcoal canister.

To accomplish the above-mentioned object, a device for purging an evaporated fuel captured by a charcoal canister according to the present invention comprises a purge path connecting the charcoal canister to an engine intake path downstream of a carburetor. In the purge path, an ON-OFF valve and a throttle having a fixed opening area are provided, parallel to each other. The ON-OFF valve is opened at engine loads higher than a predetermined engine load and is closed at engine loads lower than the predetermined engine load. In the purge path, a solenoid valve is further provided, between the engine intake path and the parallel ON-OFF valve and throttle. The solenoid valve is closed at low engine speeds and low engine temperatures and is opened at other engine operating conditions.

In the device thus constituted, at high engine loads when the ON-OFF valve is opened, the purge gas flows through both the ON-OFF valve and the throttle, increasing the volume flow of the purge gas Therefore, the charcoal canister is purged sufficiently, and the evaporated fuel capturing ability of the charcoal canister is increased. Since a large amount of air/fuel intake gas mixture flows at high engine loads in the engine intake path, the air/fuel ratio of the intake gas is little affected even if much purge gas is introduced into the engine intake path, and the drivability of the automobile does not deteriorate.

At engine speeds lower than the predetermined engine load, when the ON-OFF valve is closed, the purge gas flows only through the throttle, and the volume flow of the purge gas is reduced to the usual small volume flow. Such small volume flow of purge gas introduced into the intake path downstream of the carburetor will not deteriorate the drivability of the automobile, even if the volume flow of the intake air/fuel mixture is small.

At low engine speeds and low engine temperatures, when the solenoid valve is closed, even if the throttle valve provided in the engine intake path is suddenly opened at start of the automobile, the purge gas does not flow because the solenoid valve is closed. Therefore, the engine will not stall and the control of the air/fuel ratio of the intake gas mixture due to the purge gas will not deteriorate.

BRIEF DESCRIPTION OF THE DRAWINGS

The above and other objects, features and advantages of the present invention will be become apparent and will be more readily appreciated from the following detailed description of the preferred exemplary embodiments of the invention taken in conjunction with the accompanying drawings, in which.

DETAILED DESCRIPTION OF THE PREFERRED EMBODIMENTS

First Embodiment

Figure 1:
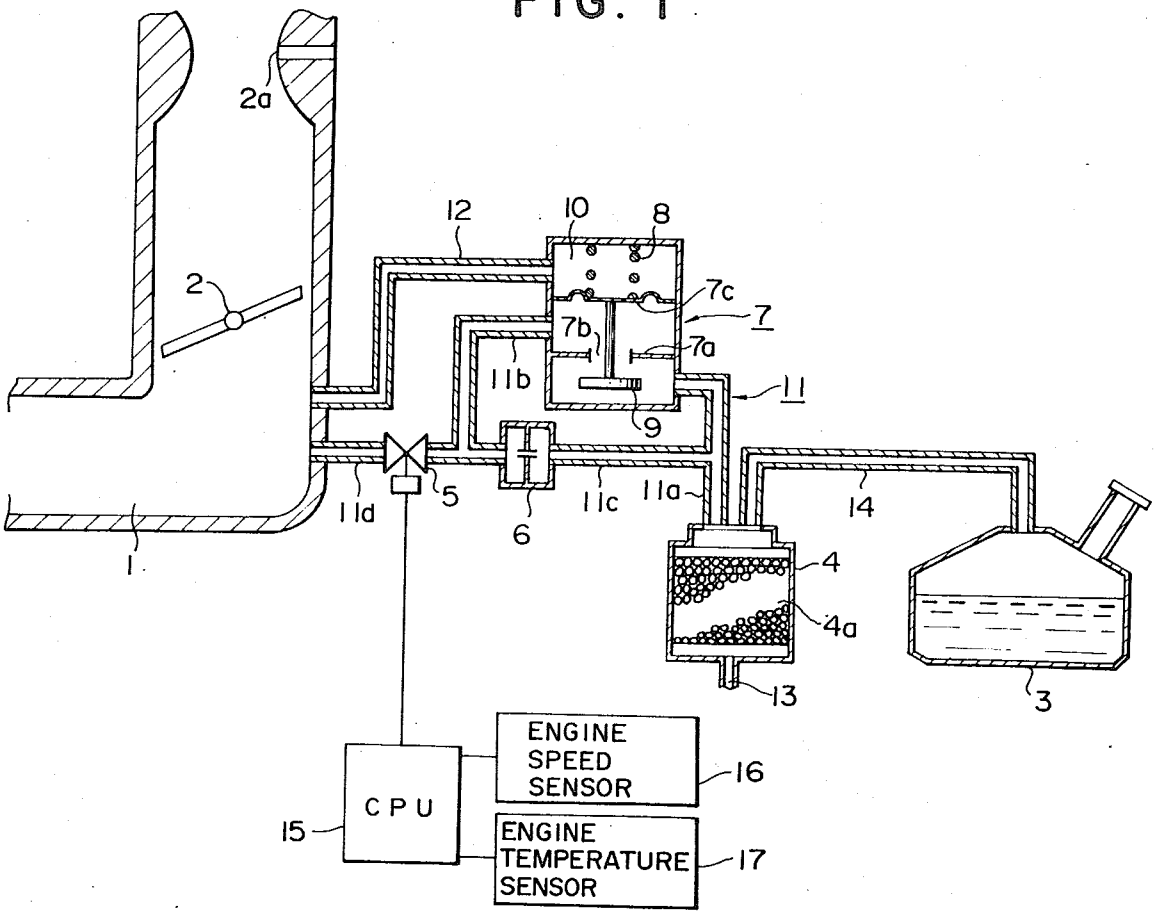
FIG. 1 is a flow path diagram of an evaporated fuel purging device according to a first embodiment of the present invention.

FIG. 1 shows a first embodiment of the present invention. In an intake path 1 of an engine, a throttle valve 2 is rotatably provided downstream of a slotted fuel injection port 2*a* of a carburetor. A purging gas from a charcoal canister 4 is introduced into the intake path 1 downstream of the throttle valve 2.

A fuel tank 3 is connected to the charcoal canister 4 via an evaporated fuel path 14. Also, a float chamber (not shown) of the carburetor is fluidly connected to the charcoal canister 4. Evaporated fuel from the fuel tank 3 and the carburetor is led into the charcoal canister 4 and is captured by charcoal 4*a* housed in the charcoal canister 4. The charcoal canister 4 is fluidly connected to the engine intake path 1 downstream of the throttle valve 2 via a purge path 11. The purge gas, which is sucked, through a canister opening 13 leading to the environment, into the charcoal canister 4 by the vacuum of the intake path 1, purges the evaporated fuel captured by the charcoal canister 4 via the purge path 11 into the engine intake path 1.

The purge path 11 includes a path 11*a* which starts at the charcoal canister 4 and extends toward the intake path 1, paths 11*b* and 11*c* which diverge from the end of the path 11*a* and are arranged in parallel, and a path 11*d* which extends from the terminal meeting point of the paths 11*b* and 11*c* to the intake path 1. In one path 11*b* of the parallel paths 11*b* and 11*c*, an ON-OFF valve 7 is provided, and in the other path 11*c* a fixed throttle 6 is provided. In the path 11*d*, a solenoid valve 5 is provided.

The ON-OFF valve 7 is opened at engine loads higher than a predetermined engine load and is closed at engine loads lower than the predetermined engine load. The ON-OFF valve 7 is operated by vacuum in the intake path 1 downstream of the throttle valve 2, but the driving mechanism of the ON-OFF valve 7 may operate by means other than the vacuum in the engine intake path 1. The ON-OFF valve 7 utilizing the intake vacuum is a diaphragm valve which comprises a plate 7*a* having a valve opening 7*b* for letting the purging gas flow therethrough, a valve body 9 for opening or closing the opening 7*b*, a diaphragm 7*c* connected to the valve body 9 so as to move together with the valve body 9, a spring 8 biasing the diaphragm 7*c* in the valve opening direction, and a vacuum chamber 10 the vacuum of which acts the diaphragm 7*c* in the valve closing direction. The vacuum chamber 10 of the ON-OFF valve 7 is fluidly connected to the intake path 1 via a vacuum path 12, and the vacuum pressure of the engine intake path 1 is led to the vacuum chamber 10 of the ON-OFF valve 7 via the vacuum path 12.

The fixed throttle 6 is constructed with an invariable flow area. The throttle 6 is arranged in parallel with the ON-OFF valve 7.

The solenoid valve 5 is located closer to the intake path 1 than the parallel ON-OFF valve 7 and throttle 6, because it is provided in the path 11*d*. The solenoid valve 5 is electrically connected to a CPU ( a control processor unit ) 15 which receives signals from an engine speed sensor 16 and an engine temperature sensor 17. According to the control of the CPU 15, the solenoid valve 5 is opened only when the engine speeds are lower than a predetermined engine speed A and the engine cooling water temperatures are lower than a predetermined engine cooling water temperature B, and is closed at other engine operating conditions. In this connection, the predetermined engine speed A is preferably set at approximately twice the engine idling speed, that is, about 1,600 rpm, and the engine cooling water temperature is preferably set between 40° C. and 60° C.

Next, the operation of the first embodiment will be explained.

Fuel evaporated from the fuel tank 3 and the float chamber (not shown) of the carburetor is led via the evaporated fuel path 14 to the charcoal canister 4 and is temporarily captured by the charcoal 4*a*. The evaporated fuel in the charcoal canister 4 is purged by the purge gas which flows, due to the vacuum of the intake path 1, when the solenoid valve 5 is opened and both the charcoal canister 4 and the engine intake path 1 are freely connected.

The suction of the purge gas is switched between the following two stages according to the engine loads.

At high engine loads, since the throttle valve 2 is opened wide, a large amount of air/fuel mixture flows in the engine intake path 1, and the intake manifold vacuum is small. Though the vacuum for sucking the purge gas is small and the vacuum acting on the diaphragm 7*c* of the ON-OFF valve 7 is also small, the valve body 9 opens the opening 7*b* of the plate 7*a* through the biasing force of the spring 8, thereby opening the path 11*b*. Therefore, the purge gas flows not only through the throttle 6 but also through the opening 7*b* provided in the ON-OFF valve 7. As a result, the flow path area is increased and a large amount of purge gas flows in spite of the small vacuum, thereby increasing the evaporated fuel capturing ability of the charcoal canister 4. At high engine loads, since much engine intake gas flows in the engine intake path 1, the increased flow of the purge gas does not affect the air/fuel ratio, thereby causing no deterioration of the drivability.

At low engine loads, if much purge gas is introduced into the engine intake path 1 downstream of the carburetor, the purge gas will make the air/fuel ratio of the air/fuel intake mixture gas lean and will impair the drivability, because the volume of the intake gas flowing through the carburetor is small. However, in the present invention, since the vacuum in the vacuum chamber 10 of the ON-OFF valve 7 becomes high in proportion to the vacuum in the intake path 1, the diaphragm 7*c* is pulled by the vacuum against the force of the spring 8 until the valve body 9 closes the ON-OFF valve 7. When the ON-OFF valve 7 is closed, the purge gas flows only through the path 11*c* including the fixed throttle 6, and the flow path area is reduced to the size of a conventional flow path area. Such small volume flow of the purge gas does not affect the fuel/air ratio of the engine intake gas and does not deteriorate the drivability of the automobile.

At start up, when the canister 4 has not yet captured enough evaporated fuel, the solenoid valve 5 closes and cuts the flow of the purging gas, because such engine operating conditions are at low engine speeds and low engine cooling water temperatures. In this connection, the sensors 16, 17 detect the engine speed and the engine cooling water temperature, respectively, and send the signals to the CPU 15. When the CPU 15 determines that the engine speeds are lower than the predetermined engine speed, for example, 1,600 rpm and the engine cooling water temperatures are between 40° C. and 60° C., CPU 15 orders the solenoid valve 5 to be closed. Therefore, even if a driver of the automobile quickly pushes the accelerator pedal and the throttle valve 2 suddenly opens at start up, the purge gas is not introduced into the engine intake path 1. Accordingly, even if the ON-OFF valve 7 is suddenly opened due to the sudden opening of the throttle valve 2 at start, engine stall does not occur because flow of the purging gas is prevented by the shut solenoid valve 5, and dilution of the engine intake gas mixture will not occur.

Second Embodiment

Figure 2:
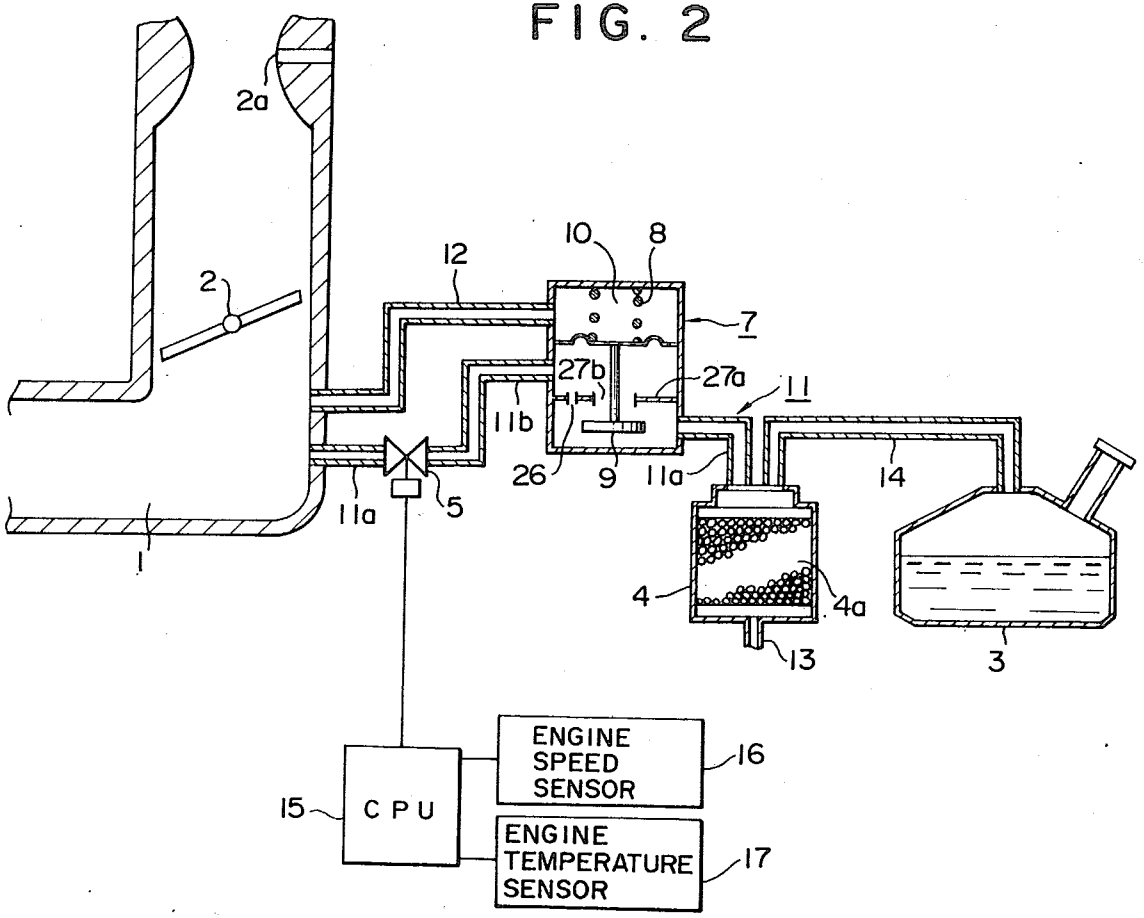
FIG. 2 is a flow path diagram of an evaporated fuel purging device according to a second embodiment of the present invention.

FIG. 2 shows a second embodiment of the present invention. The parts of the second embodiment which have the same structure as those of the first embodiment will be omitted in the explanation by attaching the same reference numerals as those of FIG. 1, and only the parts having structures different from those of FIG. 1 will be explained hereinafter.

In the second embodiment, a fixed throttle 26 is integrally provided in the ON-OFF valve 7 and is provided in the plate 27*a* having an opening 27*b* which is opened or closed by the valve body 9. In this way, the external throttle 6 and the path 11*c* of the first embodiment can be eliminated. The throttle 26 and the opening 27*b* provided in the plate 27*a* provide parallel flow paths through the plate 27*a* for the purge gas, as in the first embodiment. The operation of the second embodiment is substantially the same as that of the first embodiment.

According to the first and second embodiments of the present invention, the following effects can be obtained.

Since the solenoid valve 5 for switching the purging between ON and OFF is provided in the portion 11*d* of the purge path 11 near the engine intake path 1 and the ON-OFF switch 7 for switching the flow path area between two open degrees is provided in the portion 11*b* and/or 11*c* of the purge path 11 near the charcoal canister 4, the purging of the evaporated fuel is cut off at low engine speeds and low engine temperatures, and the purging is reduced to a small volume flow at low engine loads. However, the purging flow is increased to a large volume flow at high engine loads, resulting in increased purge gas capturing ability of the charcoal canister 4 without impairing drivability.

Although only preferred embodiments of the present invention have been described in detail, it will be appreciated by those skilled in the art that various modifications and alterations can be made to the particular embodiments shown without materially departing from the novel teachings and advantages of the present invention. Accordingly, it is to be understood that all such modifications and alterations are included within the scope of the invention as defined by the following claims.

What is claimed is:

1. A device for purging evaporated fuel captured by a charcoal canister from a fuel supply system of an internal combustion engine having an intake path and carburetor located in the intake path, the device comprising:

a purge path connecting said charcoal canister for capturing evaporated fuel to the engine intake path downstream of the carburetor;

an ON-OFF valve provided in said purge path; a fixed throttle arranged in said purge path in parallel with saidON-OFF valve;

means for operating said ON-OFF valve to be open at engine loads higher than a predetermined engine load and to be closed at engine loads lower than said predetermined engine load;

a solenoid valve provided in said purge path in series with said parallel arrangement of said ON-OFF valve and said throttle; and a means for actuating said solenoid to be closed at low engine speeds and low engine temperatures and to be open at all other engine operating conditions.

2. A device for purging evaporated fuel captured by a charcoal canister from a fuel supply system of an internal combustion engine having an intake path and a carburetor located in the intake path, the device comprising:

a purge path connecting said charcoal canister for capturing evaporated fuel to the engine intake path downstream of the carburetor;

an ON-OFF valve provided in said purge path; a fixed throttle arranged in said purge path in parallel with said ON-OFF valve;

means for operating said ON-OFF valve to be open at engine loads higher than a predetermined engine load and to be closed at engine loads lower than said predetermined engine load;

a solenoid valve provided in said purge path in series with said parallel arrangement of said ON-OFF valve and said throttle and located between said parallel arrangement and the intake path of the engine; and a means for actuating said solenoid to be closed at low engine speeds and low engine temperatures and to be open at all other engine operating conditions.

3. The device of claim 1 wherein the means for operating said ON-OFF valve comprises a vacuum chamber having a diaphragm connected to said ON-OFF valve and a vacuum path connecting said vacuum chamber to said engine intake path for actuating said diaphragm by a vacuum in said engine intake path.

4. The device of claim 1 wherein said ON-OFF valve and said fixed throttle are constructed separately from each other.

5. The device of claim 1 wherein said purge path is divided into two parallel passages, said ON-OFF valve being located in one of said two parallel passages and said fixed throttle being located in the other of said two parallel passages.

6. The device of claim 1 wherein said purge path is a single passage between said charcoal canister and said solenoid valve, said ON-OFF valve being located in said single passage and integrally including said fixed throttle.

7. The device of claim 6 wherein said ON-OFF valve comprises a plate having an opening for letting evaporated fuel flow therethrough and a valve body for opening or closing said opening, and said fixed throttle comprises an orifice formed in said plate adjacent to said opening.

* * * * *